US006409291B1

(12) United States Patent
Johnson

(10) Patent No.: US 6,409,291 B1
(45) Date of Patent: Jun. 25, 2002

(54) FURNITURE

(75) Inventor: Victor Johnson, Surrey (GB)

(73) Assignee: Panelock Systems Limited, Surrey (GB)

( * ) Notice: Subject to any disclaimer, the term of this patent is extended or adjusted under 35 U.S.C. 154(b) by 0 days.

(21) Appl. No.: 09/532,926

(22) Filed: Mar. 22, 2000

(51) Int. Cl.[7] ..... A47B 97/00; E04B 2/82
(52) U.S. Cl. ..... 312/249.8; 52/126.3; 52/143
(58) Field of Search ..... 312/249.8, 351.11, 312/351.12, 351.13; 52/126.1, 126.3, 143, 241, 243.1; 108/144, 147

(56) References Cited

U.S. PATENT DOCUMENTS

| | | | | |
|---|---|---|---|---|
| 3,400,504 A | | 9/1968 | Neisewander | 52/126.3 |
| 4,034,524 A | * | 7/1977 | Fromme et al. | 52/143 X |
| 4,535,578 A | * | 8/1985 | Gerken | 52/126.3 X |
| 4,593,874 A | | 6/1986 | Dunagan | 248/188.4 |
| 4,668,029 A | * | 5/1987 | Maizlish et al. | 312/351.13 |
| 4,841,689 A | * | 6/1989 | Schussler | 52/243.1 X |
| 5,584,546 A | | 12/1996 | Gurin et al. | 312/200 |
| 5,971,408 A | * | 10/1999 | Mandel et al. | 312/249.8 X |

FOREIGN PATENT DOCUMENTS

| | | | |
|---|---|---|---|
| DE | 24 04 875 A1 | | 8/1975 |
| DE | 24 05 027 A1 | | 8/1975 |
| DE | 26 15 266 A1 | | 10/1977 |
| DE | 26 43 905 B1 | | 2/1978 |
| FR | 2 365 668 | | 10/1977 |
| GB | 1121442 | * | 7/1968 |
| GB | 1 290 599 | | 4/1970 |
| GB | 15875053 | * | 3/1981 |

* cited by examiner

*Primary Examiner*—James O. Hansen

(57) ABSTRACT

An article of furniture, in particular, but not exclusively to wall partitions and/or cabinets which may be easily conveyed on retractable wheels whereby, retraction/extension of the wheels is affected by an over-center locking mechanism which is operatively associated with the wheels.

11 Claims, 3 Drawing Sheets

FURNITURE

FIELD OF THE INVENTION

The present invention relates to furniture. In particular but not exclusively, the present invention relates to wall partitions and/or cabinets which may be easily conveyed on retractable wheels or the like.

BACKGROUND ART

GB 1121442 describes a clamping device for enabling a wall partition to be locked between a floor and a ceiling. The clamping device is arranged to be retractably received in the top portion of the wall partition and is moveable between a retracted position and an extended position by action of springs. In the extended position, the clamping device engages with the ceiling, thereby locking the partition between floor and ceiling. To disengage the wall partition an operating cam is provided to urge the clamping device into its retracted position, against the action of the springs.

GB 1587053 describes demountable wall partitions which comprise a main panel having a spring loaded clamping member along the upper or lower edges of the panel. Retraction of the clamping member against the action of the springs is achieved using a manually operable retraction tool which has two arms. The arms are removably engagable with the clamping member and some other part of the partition, with the arms being pivotally interconnected by an over-centre locking mechanism. Cranking the arms in one direction permits the over-centre locking mechanism to be moved to a locked position with the clamping member retracted.

GB 1290599 relates to demountable wall partitions which incorporate castor wheels or rollers to support the weight of the partition when a clamping member is retracted, but are automatically relieved of the weight of the partition when the partition is clamped into position. The partition may be wheeled from one position to another by retracting the clamping member, located in the base of the partition, thereby lowering the partition from the ceiling and transferring the partition weight onto the castor wheels. In another embodiment, the head or top of the partition comprises a retractable clamping member which includes springs which overcome springs supporting the wheels located in the panel base when the clamping member is extracted.

It is an objective of the embodiments of the present invention to provide improved furniture incorporating retractable wheels, which enable the furniture to be conveyed more easily when required.

SUMMARY OF THE INVENTION

The present invention provides furniture comprising: wheels for supporting the furniture, the wheels being moveable between a retracted position and an extended position, in the retracted position the wheels being retracted within a base portion of the furniture and in the extended position the wheels extending from the base portion to support the weight of the furniture; and an over-centre locking mechanism operatively associated with the wheels, for moving the wheels between the retracted and extended positions.

Conveniently the wheels may be rollers, castors or the like which may be selected by the skilled addressee for any particular piece of furniture.

The over-centre locking mechanism is preferably located in the base portion of the display system to facilitate access to and operation of the locking mechanism. The over-centre locking mechanism may however be located at any position along a vertical centre-line of the panel. Conveniently the over-centre locking mechanism is moved between a locked and an unlocked position by use of a key or operating lever which may be inserted into a socket or hole of the locking mechanism. Alternatively, the locking mechanism may be operated by a motor, particularly an electric motor.

Preferably, a single over-centre locking mechanism serves to operate all the wheels associated with a single item of furniture; generally, two or more wheels may be provided for each item.

In a first embodiment, the furniture is in the form of a panel or wall partition which may be releasably engaged with a ceiling or ceiling track. Preferably therefore, the panel or wall partition further comprises a clamping member for engaging the ceiling. The clamping member may be retractably received in an upper portion of the panel or wall partition. Preferably, the over-centre locking mechanism controls both the retraction of the clamping member and extension of the wheels.

Preferably, each of said wheels is mounted to a lower end of a leg which extends within the panel or wall partition for linking the wheels with a part of the clamping member. In this manner, retraction of the clamping member causes the leg to be pushed downwards and the wheels to extend from the base, raising the base of the panel or wall partition from the ground.

In a second embodiment the furniture is in the form of a free standing cabinet or the like. An undercarriage unit comprising the over-centre locking mechanism and wheels may be provided in the base of the cabinet, or the over-centre locking mechanism and wheels may be integral components of the cabinet. The wheel means may be connected to the over-centre locking mechanism by a pivot arm or arms for. In use, operation of the over-centre locking mechanism causes the arm or arms to be pivoted upwards or downwards thereby raising or lowering the wheels as appropriate. Typically, a separate arm is connected to each wheel and a plurality of wheels may be controlled by a single over-centre locking mechanism.

BRIEF DESCRIPTION OF THE DRAWINGS

The present invention will now be further described in more detail, by way of example, with reference to the accompanying drawings, in which.

DETAILED DESCRIPTION OF SPECIFIC EMBODIMENTS

Figure 1:
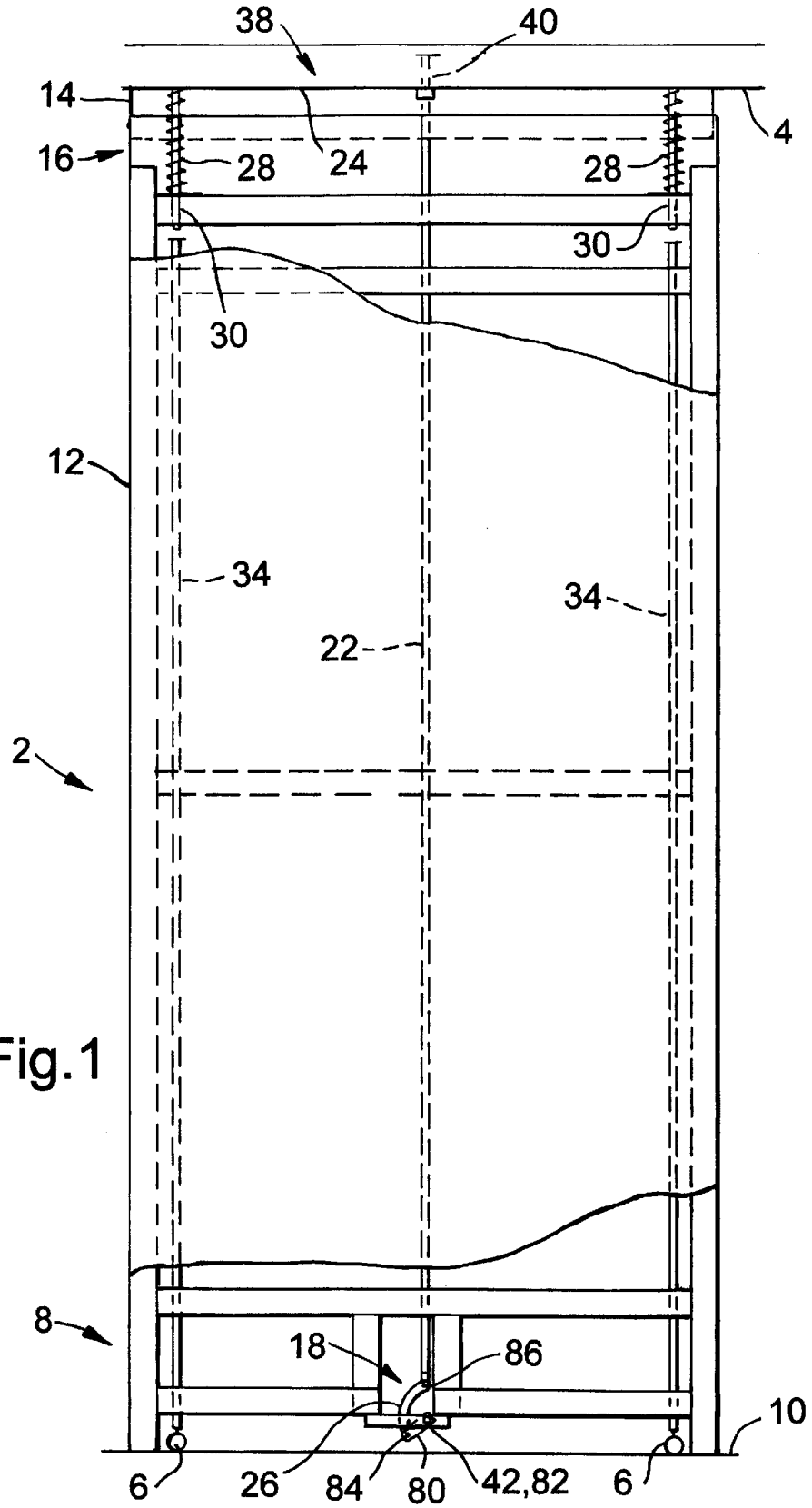
FIG. 1 shows, in partial cross section, a side view of a wall panel according to a first embodiment of the present invention, engaged with a ceiling.
Figure 2:
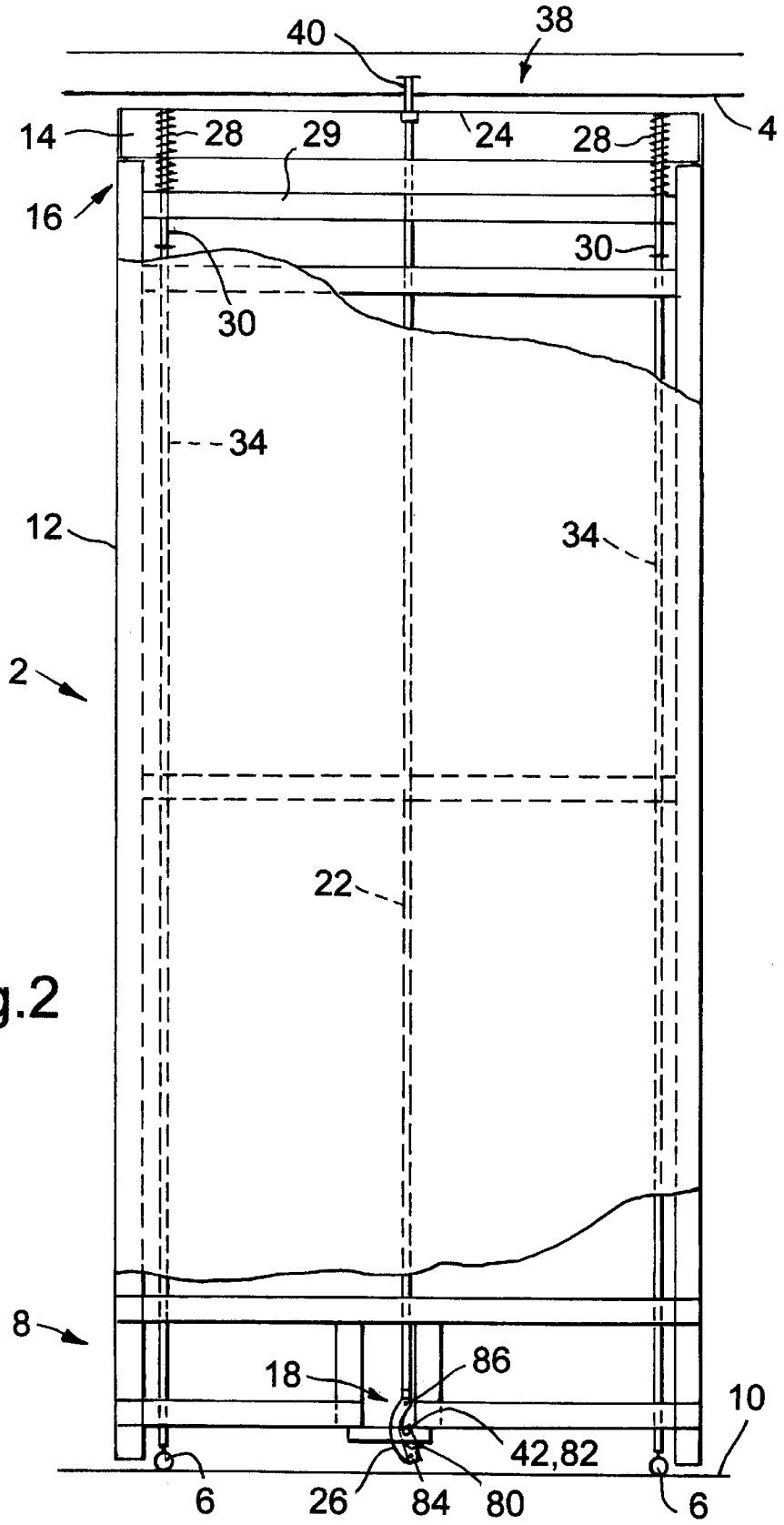
FIG. 2 shows, in partial cross section, a side view of the wall panel of FIG. 1 disengaged from the ceiling.

FIG. 1 shows a wall panel 2 according to a first embodiment of the present invention. The wall panel is engaged with a ceiling 4 and wheels 6 of the panel 2 are retracted within a base portion 8 of the panel 2, so that the base of the panel 2 rests on the ground 10. FIG. 2 shows the wall panel 2 according to FIG. 1 disengaged from the ceiling 4 with the panel weight being supported by the wheels 6 which have been extended from the base portion 8.

The wall panel 2 comprises a main panel body 12 having a clamping member 14 at an upper end portion 16 of the body 12. The clamping member 14 is shaped to be retractably received within the upper end portion 16. The clamping member 14 is connected to an overcentre locking mechanism 18, located within the panel base portion 8 by an arm 22. The arm 22 connects an underside surface 24 of the clamping member 14 and an over-centre link 26 of the locking mechanism 18. The over-centre locking mechanism 18 comprises a first pivot member 80 pivotally coupled to the frame 8 at a first pivot axis 82. A second pivot member (over-centre link 26) is pivotally coupled to the first pivot member 80 at a second pivot axis 84. The second pivot member 84 is also pivotally coupled to the arm 22 at a third pivot axis 86. The first and third pivot axes (82, 86) are located on a common longitudinal axis and when moving between unlocked and locked configurations, the second pivot axis 84 moves through the longitudinal axis to a position spaced from the longitudinal axis. The clamping member 14 has internal compression springs 28 which are located between the underside surface 24 of the clamping member 14 and a frame member 29 of the panel body 12, by spring guide rods 30. Each rod 30 extends downwards from the clamping member 14 into the panel body 12 and engages the upper end of a respective leg 34, each wheel 6 being mounted on the lower end of a leg 34.

In this particular embodiment, the panel 2 is provided in conjunction, with an overhead guide track 38, provided in the ceiling 4. The upper end of the arm 22 forms a spigot 40 which extends from the upper surface of the clamping member 14 and is received in the guide track 38. The spigot 40 serves to support the panel 2, when the panel 2 is supported by the wheels 6.

In use, in order to engage/disengage the wall panel 2 from the ceiling 4 and retract/extend the wheels 6 from the base portion 8, it is necessary to unlock/lock the over-centre locking mechanism 18 using an operating lever (not shown), which is inserted into a socket 42 of the locking mechanism 18 (located at the first pivot axis 82). Unlocking the mechanism 18, by turning the lever clockwise, allows the force of the compression springs 28 of the clamping member 14 to push the clamping member 14 into engagement with the ceiling 4 and draw the arm 22 and over-centre link 26 upwards (as shown in FIG. 1). At the same time, force applied by the clamping member 14 on the wheels 6 is released (as will be described in more detail below), relieving the wheels 6 of the weight of the panel 2 and causing the wheels 6 to be retracted within the base portion 8 and the base portion 8 to rest on the ground 10. In this manner the panel 2 is therefore engaged between the ground 10 and the ceiling 4.

The locking mechanism 18 is locked by turning the lever anti-clockwise (as shown FIG. 2). Moving the locked mechanism 18 to the locked position draws the over-centre link 26 and arm 22 downwards. In so doing, the clamping member 14, to which the arm 22 is connected, is retracted into the panel body 12. Retraction of the clamping member 14 compresses the springs 28 and moves the spring guide tubes 30 to extend downwards into engagement with the wheel rods 34. Further rotation of the lever pushes the rods 34 and associated castor wheels 6 downwardly to raise the panel 2 from the ground 10. Once the mechanism 18 passes the over-centre position, the mechanism 18 automatically locks, leaving a space between the clamping member 14 and the ceiling 4 and between the base portion 8 and the ground 10; the result is the panel 2 is now supported on the wheels 6 and the panel 2 may be moved without difficulty.

Figure 3A:
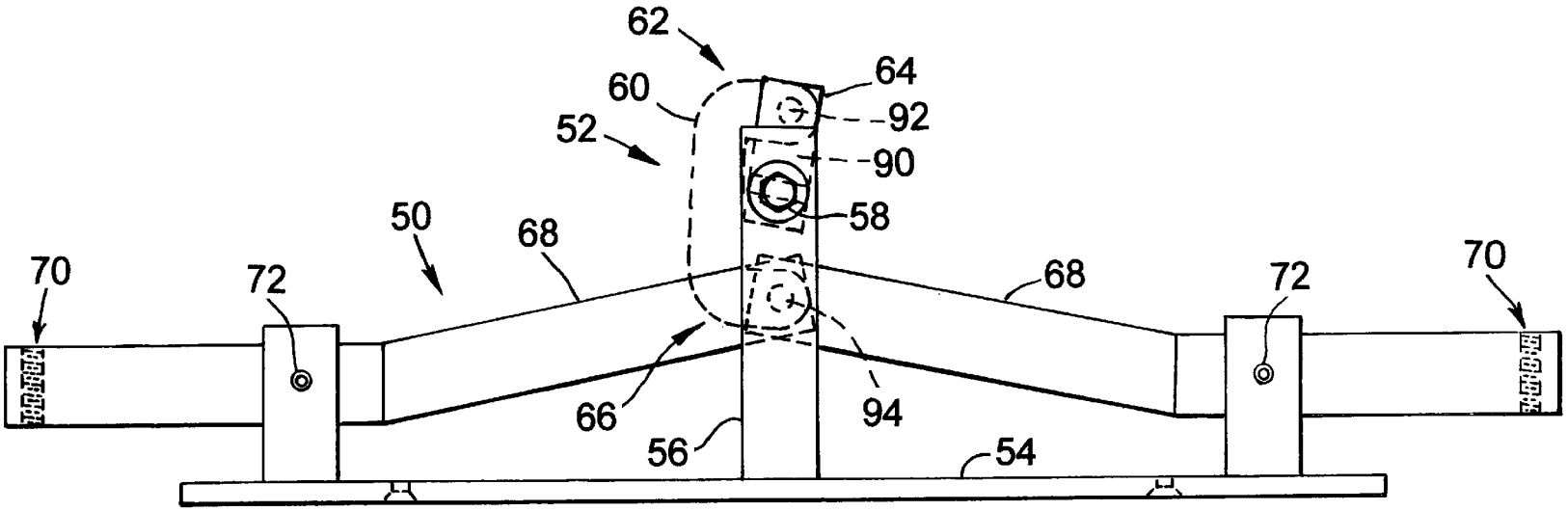
FIGS. 3*a* and 3*b* show side and top views respectively of an undercarriage assembly unit for use with a display cabinet according to a second embodiment of the present invention.
Figure 3B:
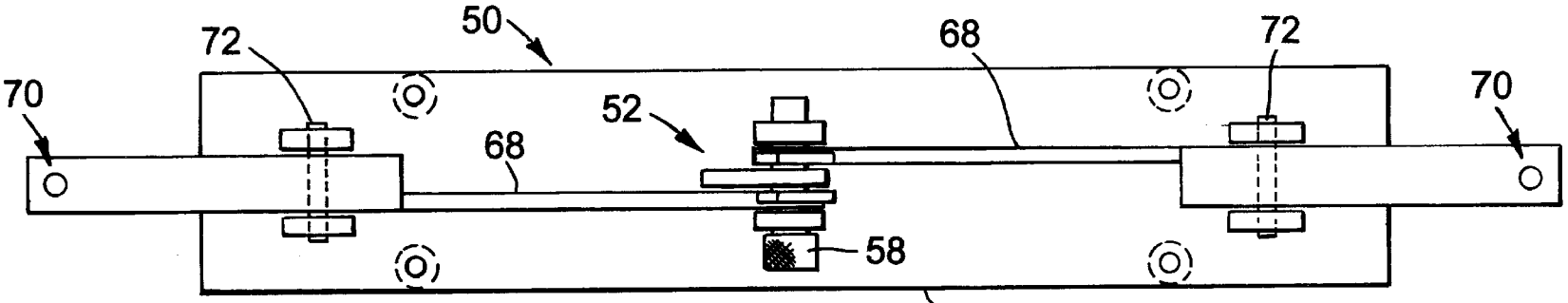

It will be appreciated that the configuration of the over-centre link 26 may be adjusted for particular application. Thus, it is possible by increasing the length of the over-link 26, to increase the gap between the ground 10 and ceiling 4, when the panel 2 is resting on the castor wheels 6. Other components may also be modified to accommodate any size of wall panel. FIGS. 3*a* and 3*b* show side and top views respectively of an undercarriage assembly 50 for use in a display cabinet according to a second embodiment of the present invention.

The under carriage assembly 50 comprises an over-centre locking mechanism 52 which is shown in a locked position. The over-centre locking mechanism 52 comprises a first pivot member 90 pivotally coupled to the frame 56 at a first pivot axis 58. A second pivot member (over-centre link 60) pivotally coupled the first pivot member 90 at a second pivot axis 92. The second pivot member 60 is also pivotally coupled to operating members (arms 68) at a third pivot axis 94. The first and third pivot axes 58, 94 are located on a common longitudinal axis and when moving between unlocked and locked configurations, the second pivot axis 92 moves through the longitudinal axis to a position spaced from the longitudinal axis. The undercarriage assembly 50 may be an integral part of a display cabinet, or alternatively, the undercarriage assembly 50 may be housed within a plinth (not shown) upon which an existing cabinet may be placed. In this manner a conventional cabinet without wheels may be transformed into a cabinet with wheels.

The undercarriage assembly is mounted on an anchor plate 54, with the over-centre locking mechanism 52 mounted on the anchor plate 54 by a leg 56. The over-centre locking mechanism 52 is secured to the leg 56 by an operating bolt 58. The over-centre locking mechanism 52 has an over-centre link 60, an upper end 62 of which is connected to the operating bolt 58 by a clevis block 64, while a lower end 66 of the link 60 is connected to two wheel supporting arms 68. The arms 68 are mounted to the anchor plate 54 by pivot pins 72 and the wheels (not shown) are mounted on the free ends 70 of the arms 68. When the upper ends of the arms 68 are raised, the free ends of the arms 68 pivot on the pivot pins 72, lowering the wheels to the ground and raising the cabinet from the ground.

Unlocking the locking mechanism 52, allows the wheels to retract into the cabinet under the influence of the weight of the cabinet. It is to be appreciated that the length of the operating bolt 58 may be increased to allow further over-centre links 60 to be operated. Thus, operation of the bolt 58 would serve to operate more than one over-centre link, thereby controlling the raising and lowering of any number of wheels. Typically four castor wheels may be controlled by a single overcentre locking mechanism 52, each wheel being positioned at a corner of a square or rectangular cabinet.

It will be appreciated by the skilled addressee that various modifications may be carried out in relation to the present invention, without departing from the scope thereof. For example, the over-centre locking mechanism 18 of the panel 2 may be located within the upper end portion 16 of the panel 2, rather than in the base portion 8. The arm 22 would therefore be reduced in length as it would not now extend within the panel body 12. The panel 2 may then be adapted to incorporate additional door units, or full height glazed units.

Furthermore, it is possible to incorporate an over-centre locking mechanism 18 within the panel 2, which is at right angles to the over-centre locking mechanism 18 as shown in FIGS. 1 and 2. In this manner, the panel 2 may be adapted to have a clamping member along either or both edges of the panel 2 so as to allow the panel 2 to be releasably engaged with opposing walls, rather than the ground and ceiling.

What is claimed is:

1. An article of furniture comprising a frame and wheels for supporting the furniture, the wheels being moveable between a retracted position and extended position, in the retracted position the wheels being retracted within a base portion of the furniture and in the extended position the wheels extending from the base portion to support the weight of the furniture; and an over-center locking mechanism comprising a first pivot member pivotally coupled to the frame at a first pivot axis, and a second pivot member pivotally coupled to the first pivot member at a second pivot axis, the second pivot member also being pivotally coupled to an operating member at a third pivot axis, the first and third pivot axes being located on a common longitudinal axis and when moving between unlocked and locked configurations, the second pivot axis moves through said longitudinal axis to a position spaced from said longitudinal axis, said locking mechanism being operatively coupled with the wheels, for moving the wheels between the retracted and extended positions.

2. An article of furniture according to claim 1 wherein the over-center locking mechanism is located in the base portion of the furniture.

3. An article of furniture according to claim 1 wherein the over-center locking mechanism is moved between a locked and unlocked position by a key or operating lever which is inserted into a socket or hole of the locking mechanism.

4. An article of furniture according to claim 1 wherein the over-center locking mechanism is operated by a motor.

5. An article of furniture according to claim 1 wherein a single over-center locking mechanism serves to operate all the wheels associated with the furniture.

6. An article of furniture according to claim 1 wherein the furniture is a panel or wall partition which is releasably engaged with a ceiling or ceiling track.

7. An article of furniture according to claim 6 wherein the panel or wall partition further comprises a clamping member for engaging the ceiling or ceiling track.

8. An article of furniture according to claim 7 wherein the over-center locking mechanism controls both the retraction of the clamping member and extension of the wheels.

9. An article of furniture according to claim 8 wherein each of said wheels is mounted to a lower end of a leg which extends within the panel or wall partition for linking the wheels with a part of the clamping member.

10. An article of furniture according to claim 1 in the form of a free standing cabinet.

11. An article of furniture according to claim 10 wherein the wheel means are connected to the over-center locking mechanism by a pivot arm or arms.

* * * * *